US007395775B2

(12) United States Patent
LaScala

(10) Patent No.: US 7,395,775 B2
(45) Date of Patent: Jul. 8, 2008

(54) COVER FRAME SUPPORT CLAMP FOR PONTOON BOAT RAILS

(76) Inventor: Patrick J. LaScala, P.O. Box 94, City Island, NY (US) 10464

( * ) Notice: Subject to any disclaimer, the term of this patent is extended or adjusted under 35 U.S.C. 154(b) by 145 days.

(21) Appl. No.: 11/505,380

(22) Filed: Aug. 17, 2006

(65) Prior Publication Data

US 2008/0042027 A1 Feb. 21, 2008

(51) Int. Cl.
*B63B 17/00* (2006.01)

(52) U.S. Cl. ..... 114/361; 114/364; 248/231.71

(58) Field of Classification Search ..... 114/361, 114/364; 248/230.6, 231.71
See application file for complete search history.

(56) References Cited

U.S. PATENT DOCUMENTS 3,863,900 A * 2/1975 Dagiel et al. ..... 256/59
5,007,612 A * 4/1991 Manfre ..... 248/558
5,020,765 A * 6/1991 Evans et al. ..... 248/539
5,353,826 A * 10/1994 Davis, Sr. ..... 135/88.13
5,579,968 A * 12/1996 Staschiak ..... 224/274
5,628,485 A * 5/1997 Ray ..... 248/231.61
6,260,505 B1 * 7/2001 Polidan ..... 114/361
7,107,926 B2 * 9/2006 Fishburn ..... 114/361
2006/0254190 A1 * 11/2006 Hunt ..... 52/698

* cited by examiner

*Primary Examiner*—Stephen Avila
(74) *Attorney, Agent, or Firm*—Donald W. Meeker

(57) ABSTRACT

A series of adjustable padded support clamps attach to pontoon boat rectangular rails to support the structural frame members of a boat cover. Each two-part support clamp comprises a first padded square C-shaped channel bracket member having an aperture in a top arm thereof, and a second post and plate member. The post protrudes up through the aperture in the top arm of the C-shaped channel bracket to receive a coupling of a frame member of the boat cover. A bottom padded plate of the second member is adjustably secured against a top of the boat rail by turning one or more adjusting screws to draw the padded bottom arm up securely against a bottom of the boat rail.

4 Claims, 3 Drawing Sheets

COVER FRAME SUPPORT CLAMP FOR PONTOON BOAT RAILS

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to boat covers and particularly to an adjustable padded support clamp for attaching the structural frame members of a boat cover to a pontoon boat rectangular rail, the two-part clamp comprising a first interior padded square C-shaped channel bracket member having an aperture in a top arm thereof, and a second post and plate member with bottom padding, wherein the post protrudes up through the aperture in the top arm of the C-shaped channel bracket to receive a coupling connecting to a frame member with the bottom padded plate of the second member adjustably secured against a top of the boat rail by turning one or more adjusting screws to draw the bottom arm up securely against a bottom of the boat rail.

2. Description of Related Art Including Information Disclosed Under 37 CFR 1.97 and 1.98

Traditionally, a removable boat canopy includes a framework of a plurality of arched tubes forming the upper frame of the boat canopy. The arched tubes are mounted on the gunwale or railing of the boat. Most of the rails on boats are formed of cylindrical tubing, but pontoon boats have rectangular rails requiring a different clamp than that used on other boats. Furthermore, the seats of the pontoon boats butte up against the rails making it difficult to mount a clamp on the top of the rails. The prior art does not adequately address this problem.

U.S. Pat. No. 6,260,505, issued Jul. 17, 2001 to Polidan, describes a cover system for a pontoon boat having a rail. The cover system includes a framework for receiving a flexible material cover thereon. The framework has hollow end fittings engageable to brackets. Each bracket has a U-shaped configuration with inwardly projected protuberances along lateral ends to grasp the underside of the rail. The bracket has a center section between two lateral sections and the center section has a vertically extending portion thereon configured for being received into an end fitting.

U.S. Pat. No. 2,493,833, issued Jan. 10, 1950 to Reynolds, is for rib-like canopy support members that form a detachable boat cover frame which can be applied to and removed from the boat by one person. Each end of each rib-like support member is attached to a U-shaped clamp which secures the rib to the side of the boat. U.S. Pat. No. 3,354,892, issued Nov. 28, 1967 to Frieder, provides an arched boat canopy which, in an alternate embodiment, uses a clamping device to secure each arch arm to the gunwale of the boat.

U.S. Pat. No. 5,353,826, issued Oct. 11, 1994 to Davis, shows an easily removable tent topper designed to be installed on a truck bed when needed and be road worthy at highway speeds. The tent topper comprises a plurality of roll bar shaped assemblies and a tent. The tent has openings therein at pre-selected locations which permit the tent to engage a plurality of adjustable pins, the pins being part of the roll bar shaped assemblies. The adjustable pins permit stretching or making taut the tent. Furthermore, the tent topper can be easily removed, disassembled, and stored in the truck cab behind the seat, as many truck owners do not like to permanently affix camper-type shells on their truck beds.

U.S. Pat. No. 4,671,203, issued Jun. 9, 1987 to Sanburg, claims a boat supported duck blind adapted for mounting on the gunwales of a boat hull. The duck blind includes separate bow, stern and central frame sections adapted for use on various size boats. Each leg of each central frame member is removably mounted in a hull mounted channel bracket provided with a set screw.

U.S. Pat. No. 4,979,456, issued Dec. 25, 1990 to Steward, discloses a boat supported blind including first frame structure having a first frame member for being coupled to the first sidewall of the boat, a second frame member for being coupled to the second sidewall of the boat, and a third frame member for joining the upper ends of the first and second frame members; a second frame structure having a first frame member for being coupled to the first sidewall of the boat, a second frame member for being coupled to the second sidewall of the boat, and a third frame member for joining the upper ends of the first and second frame members; and cover structure for substantially covering the frame structures and the boat. The cover structure includes a first cover member for covering the first frame members of the first and second frame structures, and a second cover member for covering the second frame members and a portion of the third frame members of the first and second frame structures.

U.S. Pat. No. 5,520,139, issued May 28, 1996 to King, indicates a boat canopy which can be removably mounted onto the gunwales of a boat, and which can be adjusted forward and backward into various positions. The canopy comprises a canvas top and a plurality of bows which are assembled as one piece, a plurality of leg supports, a plurality of clamps which clamp onto the gunwales, and a plurality of quick-disconnect pins which allow for easy assembly and disassembly.

U.S. Pat. No. 2,829,660, issued Apr. 8, 1958 to Wester, puts forth a boat canopy which can be removably mounted onto the gunwales of a boat by means of clamps. Each clamp holds a plurality of frame end members.

U.S. Pat. No. 2,689,579 issued Sep. 21, 1954 to Sartori, also illustrates a boat canopy which can be removably mounted onto the gunwales of a boat by means of clamps. Each clamp holds a plurality of frame end members.

U.S. Pat. No. 3,032,046, issued May 1, 1962 to Coonradt, concerns a collapsible awning for use on small boats. The awning panel has edge flaps and wraps around a frame and secured by fasteners thereto. A separate clamp is used to attach the device to a gunnel of a small boat.

U.S. Pat. No. 2,618,285, issued Nov. 18, 1952 to Heisig, is for an adjustable awning for use on boats, beaches or elsewhere. The awning is supported by two lower support arms which are attached by channel clamps to a boat's gunwale.

What is needed is a frame support clamp for a pontoon boat rail that can be mounted from the outside of the rail and one which adjusts to rails of various sizes.

BRIEF SUMMARY OF THE INVENTION

An object of the present invention is to provide an open-sided frame support clamp for a pontoon boat rail that can be mounted from the outside of the rail and one which adjusts vertically to rails of various sizes.

A related object of the present invention is to provide a interior padded square C-shaped clamp to be positioned so that one of the two arms of the square C with a large center opening therein is positioned above the rectangular pontoon boat rail and the other below the rail, the padded connecting portion of the square C positioned against an outside face of the rail and a vertically adjustable bottom padded plate contacting a top surface of the rail and a vertical cylindrical frame support shaft extending upwardly from the plate through the opening in the top arm of the square C and a pair of threaded fasteners screwed adjustably through two small threaded openings, one on each side of the large center opening of the upper arm, screwed down onto the plate causing the padded bottom arm to draw up tightly against the bottom of the rail with the padded plate securely tightly against the top of the rail and the frame support shaft protruding upwardly to receive a bottom of a coupling attached to a cover frame support so that each of a series of padded clamps along the rail grips the rail securely to support a boat cover frame support.

In brief, the present invention comprises an adjustable padded support clamp for attaching the structural frame members of a boat cover to the side of a pontoon boat rectangular rail. The two-part clamp comprises a first padded square C-shaped channel bracket member having an aperture in a top arm thereof, and a second post and plate member of which the post portion protrudes up through the aperture in the top arm of the C-shaped channel bracket to receive a coupling to a frame member of the boat cover. The padded plate of the second member is adjustably secured against a top of the boat rail by turning one or more adjusting screws to draw the bottom arm up securely against a bottom of the boat rail. The support clamp is mounted from the outside of a boat rail, thereby avoiding moving or marring the boat seat which rests against the inside of the rail.

An advantage of the present invention is that it can be can mounted from the outside of the boat rail.

Another advantage of the present invention is that it adjusts vertically to boat rails of various sizes.

One more advantage of the present invention is it avoids moving or marring the boat seat that rests against the inner side of the boat rail.

BRIEF DESCRIPTION OF THE SEVERAL VIEWS OF THE DRAWINGS

These and other details of my invention will be described in connection with the accompanying drawings, which are furnished only by way of illustration and not in limitation of the invention, and in which drawings.

DETAILED DESCRIPTION OF THE INVENTION

Figure 1:
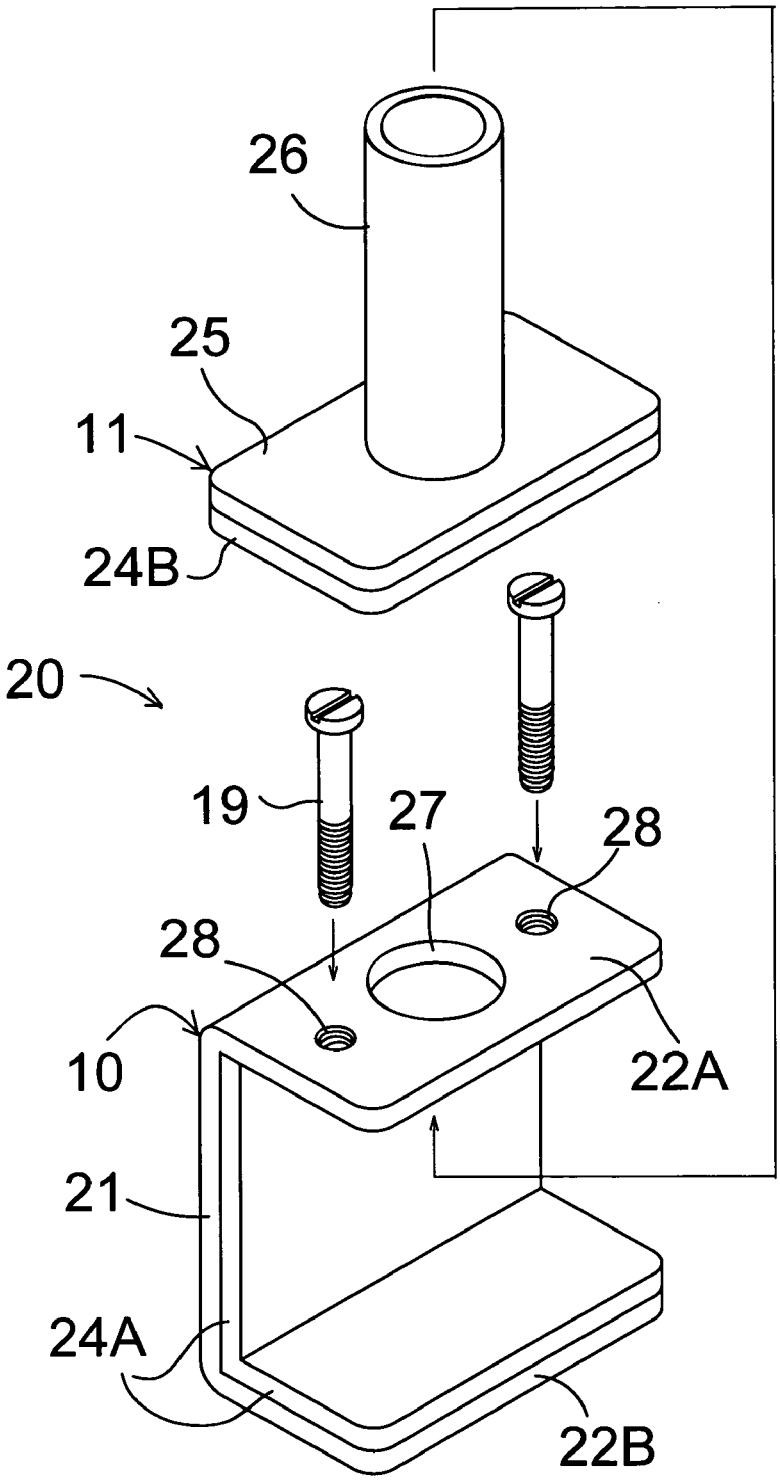
FIG. 1 is an exploded perspective view of the boat cover frame support clamp of the present invention for a rectangular pontoon boat rail showing the parts of the clamp.
Figure 2:
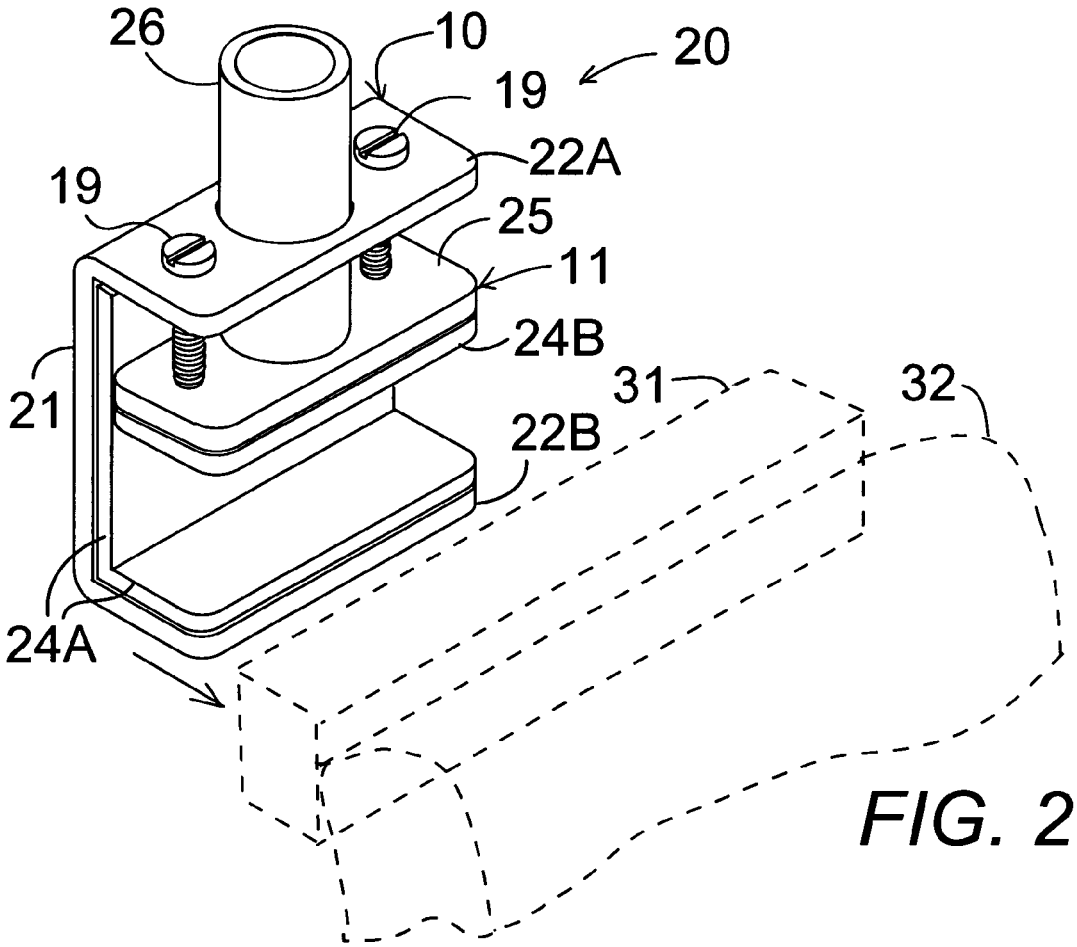
FIG. 2 is a perspective view of the boat cover frame support clamp of FIG. 1 aligned for mounting from the outside of a rectangular pontoon boat rail showing the pontoon boat seat resting against the inside of the rail.
Figure 3:
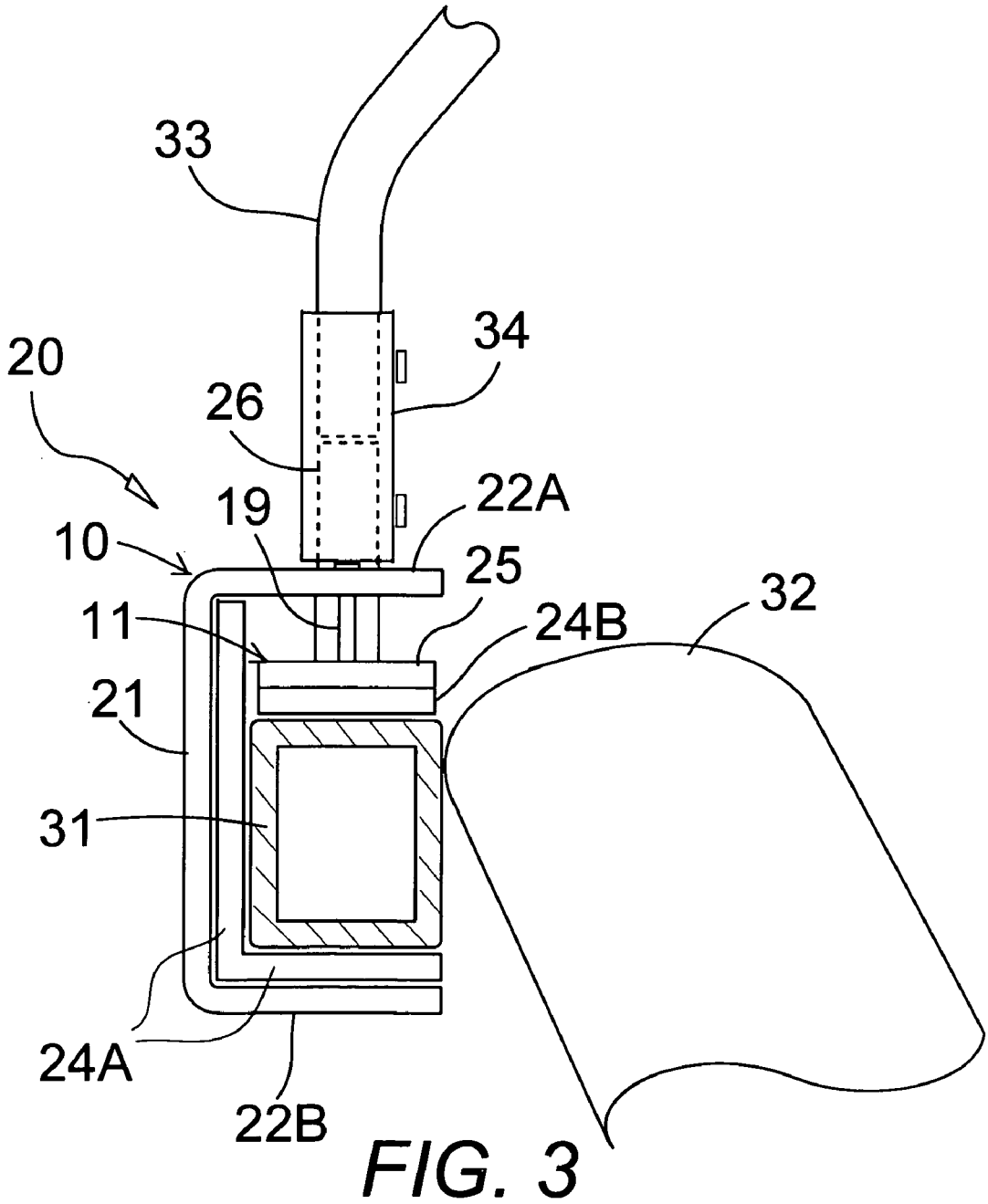
FIG. 3 is a side elevational view in partial section of the boat cover frame support clamp of FIG. 1 mounted on a rectangular pontoon boat rail with the rail in cross-section, the pontoon boat seat shown contacting the inside of the rail, and a cover frame support member attached by a coupling to the support clamp.

In FIGS. 1-3, an open-sided frame support clamp device 20 for a rectangular rail 31 can be mounted from the outside of the rail. The two parts, a channel bracket 10 and a movable clamp plate 11 adjust vertically to rails 31 of various sizes.

The channel bracket 10 is formed of weather proof metal in a square C shape having a top horizontal arm 22A, a bottom horizontal arm 22B and a vertical connecting side 21 therebetween rigidly connecting the two arms. The channel bracket has a soft padding material 24A attached to an inside surface of the bottom arm 22B and an inside surface of the vertical connecting side 21. The top arm has a large center opening 27 therethrough and two small threaded openings 28 therethrough spaced apart from the center opening on each of two sides of the center opening, and two threaded fasteners 19 to thread into the threaded openings.

The clamp plate 11 comprises a rigid horizontal plate 25 and a rigid vertical frame support post 26 rigidly attached to a top center of the clamp plate and extending upwardly therefrom. The frame support post is sized to fit within the center opening of the top arm 22A with a sliding friction fit, with the clamp plate 25 normally positioned within the channel bracket 10 with the frame support post 26 inserted up through the center opening 27 of the channel bracket. A soft padding material 24B is attached to a bottom surface of the clamp plate for contacting the top of the rail.

In FIGS. 2 and 3, the open-sided frame support clamp is mountable on a rectangular rail 31 from a side of the rectangular rail with the padded bottom 24B of the clamp plate contacting a top of the rectangular rail 31 and a padded top 24A of the bottom arm 22B of the channel bracket 10 contacting a bottom of the rectangular rail 31 with the two threaded fasteners 19 screwed through the top arm down 22A onto the clamp plate 11 to draw the clamp plate and bottom arm together with the rectangular rail sandwiched therebetween. This allows the open-sided frame support clamp to be mounted without moving or marring the pontoon boat seat 32, which rests against the rectangular rail 31. In FIG. 3, the clamp plate is adjustable in vertical position to fit a variety of sizes of rectangular rails, thereby removably securing the open-sided frame support clamp 20 to the rectangular rail 31 with the frame support post 26 extending vertically upward from the rectangular rail to receive a coupling 34 screwed to the bottom of a vertical frame member 33 of a cover frame and screwed to the frame support post 26 to support the vertical frame member.

In FIG. 3, the open-sided frame support clamp is structured to fit on a wide variety of sizes of pontoon boat rectangular rails and the frame support post 26 is structured to fit with the coupling 34 from the cover support frame member 33 so that the pontoon boat cover support frame member is secured over the frame support post by the coupling 34.

A series of open-sided frame support clamps can be spaced along a spaced pair of rectangular rails, preferably on a pontoon boat, that support a series of vertical frame members to support a cover frame between the pair of spaced rectangular rails.

In use, the support post 26 of the clamp plate 25 is inserted through the center aperture 27 in the top 22A of the channel bracket 10. The channel bracket is slid onto the outer side of a horizontal pontoon boat rail 31 with the bottom arm 22B of the channel bracket under the bottom of the rail and the padded bottom 24B of the clamp plate 25 resting on the top of the rail. Two screws 19 are screwed into the threaded openings 28 on the top arm 22A of the channel bracket, drawing the bottom arm up and securing the clamp plate tightly and securely onto the top of the rail. A series of open-sided frame support clamps are mounted to each of the horizontal rails of the pontoon boat.

A coupling 34 is secured by a screw to a bottom end of each of the pontoon boat cover support frame members 33 and secured by a screw to a frame support post 26 with the series of support clamp devices 20 attached to the rails 31 on both sides of the pontoon boat, allowing the pontoon boat cover to be securely fastened to the boat.

It is understood that the preceding description is given merely by way of illustration and not in limitation of the invention and that various modifications may be made thereto without departing from the spirit of the invention as claimed.

What is claimed is:

1. An open-sided frame support clamp device for a rectangular rail that can be mounted from the outside of the rail which adjusts vertically to rails of various sizes, the device comprising:

a channel bracket formed of weather proof metal in a square C shape having a top horizontal arm, a bottom horizontal arm and a vertical connecting side therebetween rigidly connecting the two arms, the channel bracket comprising a soft padding material attached to an inside surface of the bottom arm and an inside surface of the vertical connecting side, the top arm having a large center opening therethrough and a small threaded opening therethrough spaced apart from the center opening on each of two sides of the center opening, and two threaded fasteners to thread into the threaded openings;

a clamp plate comprising a rigid horizontal plate and a rigid vertical frame support post rigidly attached to a top center of the clamp plate and extending upwardly therefrom, the frame support post sized to fit within the center opening of the top arm with a sliding friction fit, the clamp plate normally positioned within the channel bracket with the frame support post inserted up through the center opening, and a soft padding material attached to a bottom surface of the clamp plate to form an open-sided frame support clamp so that the open-sided frame support clamp is mountable on a rectangular rail from a side of the rectangular rail with the padded bottom of the clamp plate contacting a top of the rectangular rail and a padded top of the bottom arm of the channel bracket contacting a bottom of the rectangular rail with the two threaded fasteners screwed through the top arm down onto the clamp plate to draw the clamp plate and bottom arm together with the rectangular rail sandwiched therebetween so that the clamp plate is adjustable in vertical position to fit a variety of sizes of rectangular rails, thereby removably securing the open-sided frame support clamp to the rectangular rail with the frame support post extending vertically upward from the rectangular rail to receive a coupling from a bottom of a vertical frame member of a cover frame connected to the frame support post.

2. The device of claim 1 wherein a series of open-sided frame support clamps spaced along a spaced pair of rectangular rails and the rectangular rails support a series of vertical frame members to support a cover frame between the pair of spaced rectangular rails.

3. The device of claim 1 the open-sided frame support clamp is structured to fit on a wide variety of sizes of pontoon boat rectangular rails and the frame support post is structured to fit with a coupling of a pontoon boat cover support frame member.

4. The device of claim 3 wherein a series of open-sided frame support clamps spaced along the length of each of two side rectangular rails of the pontoon boat and the rectangular rails support a series of vertical frame members to support a pontoon boat cover frame between the pair of side rectangular rails.

* * * * *